US005837943A

United States Patent [19]

Kellett

[11] Patent Number: 5,837,943

[45] Date of Patent: Nov. 17, 1998

[54] ELECTRICAL POWER LINE INSULATOR WITH UNIVERSAL END CLAMP

[76] Inventor: E. Glenn Kellett, P.O. Box 914, Hamilton, Bermuda

[21] Appl. No.: 154,721

[22] Filed: Nov. 19, 1993

Related U.S. Application Data

[63] Continuation of Ser. No. 865,947, Apr. 9, 1992, abandoned.

[51] Int. Cl.[6] ..... H01B 17/16

[52] U.S. Cl. ..... 174/169; 24/135 R; 248/74.4

[58] Field of Search ..... 174/170, 168, 174/169, 40 R, 154, 172, 174, 146; 24/525, 569, 135 R; 248/231.4, 316.4, 74.4

[56] References Cited

U.S. PATENT DOCUMENTS

| | | | |
|---|---|---|---|
| 530,706 | 12/1894 | McCarthy | 174/169 |
| 578,825 | 3/1897 | Luscomb et al. | 174/169 |
| 887,107 | 5/1908 | Locke | 174/169 |
| 2,195,020 | 3/1940 | Bodendieck | 174/169 |
| 2,584,743 | 2/1952 | Schoonmaker | 24/135 R |
| 2,775,422 | 12/1956 | Von Herbulis | 248/63 |
| 2,779,815 | 1/1957 | Sokol | 174/169 |
| 2,975,997 | 3/1961 | Lindsey | 248/63 |
| 3,026,368 | 3/1962 | Lindsey | 174/169 |
| 3,267,206 | 8/1966 | Leonard, Jr. | 174/169 |
| 3,383,739 | 5/1968 | Pitzel | 24/132 R |
| 3,437,299 | 4/1969 | Lindsey . | |
| 3,437,742 | 4/1969 | Lindsey | 174/169 |
| 3,437,743 | 4/1969 | Lindsey | 174/169 |
| 3,547,386 | 12/1970 | Burgess | 248/63 |
| 3,623,687 | 11/1971 | Nordstrom | 174/169 X |
| 3,836,102 | 9/1974 | Hall | 174/169 X |
| 3,872,267 | 3/1975 | Kerr | 174/169 X |
| 4,178,470 | 12/1979 | Jean et al. | 174/168 |
| 4,579,306 | 4/1986 | Kellett et al. | 248/74.1 |
| 4,727,224 | 2/1988 | Kellett et al. | 174/169 |
| 5,064,971 | 11/1991 | Bogdanow | 174/169 |

FOREIGN PATENT DOCUMENTS

| | | | |
|---|---|---|---|
| 2234260 | 1/1973 | Germany | 174/169 |
| 0020367 | of 1909 | United Kingdom | 24/525 |

*Primary Examiner*—Hyung-Sub Sough
*Attorney, Agent, or Firm*—Ridout & Maybee

[57] ABSTRACT

A one piece electrical power line post insulator having a universal end clamp replaces traditional trunnion or top tie style devices. In a preferred embodiment, the invention has an insulator with a support structure base fitting at one end and a clamp at the other. The base fitting allows attachment of the device to a support structure in either a substantially vertical or horizontal orientation. The clamp has a saddle for receiving a conductor when the device is either in a horizontal or vertical orientation. A keeper is movable on a captive bolt along a track defined in the clamp body and is securable over a conductor by a lock washer and nut on the bolt.

9 Claims, 1 Drawing Sheet

ELECTRICAL POWER LINE INSULATOR WITH UNIVERSAL END CLAMP

This application is a continuation of application Ser. No. 07/865,947, filed Apr. 9, 1992 now abandoned.

The invention is a one piece electrical power line insulator having a universal end clamp.

The attachment of an electric power conductor to a support structure requires the use of an electric insulator and some type of conductor securement means such as a clamp. More than thirty years ago, ceramic top tie insulators were commonly used for this purpose. The ceramic insulators had grooves or saddles for receiving conductors, which were attached to the ceramic insulators by tie wires. The bulky and heavy ceramic insulators were found to pose a safety hazard in many applications and were generally difficult and cumbersome to install and maintain.

Mechanical clamps used in conjunction with porcelain and polymeric insulators supplanted the ceramic top tie devices and have been in conventional use for about thirty years. While an improvement over top tie insulators, the mechanical clamp and insulator as a separate two piece system suffers from a number of problems. The insulator portion of such two piece devices have a threaded metal end fitting for attachment to a support structure and a ceramic or polymer rubber insulator extending from the end fitting to a metal trunnion end which may have either a horizontal or a vertical configuration. An insulator having a horizontal trunnion end is used when the insulator is attached substantially horizontally to the support structure; whereas, a vertical trunnion end is used for substantially vertical insulator attachments.

The trunnion ends may receive and hold a conductor stringer block to assist the initial stringing or replacement of conductor. The trunnion end may also receive and hold a mechanical clamp for the conductor once it has been strung. The trunnion arrangement is unsatisfactory because it requires the installation of the clamp by first backing off of the securing bolt associated with the trunnion end. The bolt holding the clamp in the trunnion provides an axle for pivotal movement of the clamp. Since the conductor keeper portion of some clamps must be removed from the saddle portion of the clamp by removing bolts and associated washers, the procedure for clamping a conductor in place is awkward at best and may be unsafe in many instances involving a trunnion end clamp.

The use of removable bolts and washers provides ample opportunity for parts to be dropped during installation or to be lost during storage and handling operations. Wastage of time and material is a major problem facing line crews and utility companies. Likewise, the need to use different insulators for horizontal and vertical applications leads to inevitable problems in inventory management and in correctly supplying crews in the field. This problem also plagues the mechanical clamps used since as many as three different clamp sizes may be required for securing conductors of different sizes.

The currently used separate insulator and clamp arrangement is also quite unsatisfactory in line maintenance situations. Repairs to the support structure holding a live conductor often involves replacing the clamps and insulator. Using the two piece clamp and insulator, the lineman must exhibit extreme care in his work methods to avoid an obviously hazardous situation.

The present invention provides the first practical advance in this art in nearly thirty years and overcomes the various problems and hazards associated with the currently used two piece system. Accordingly, the invention provides a one piece electrical power line insulator having a universal end clamp suitable for substantially horizontal or vertical applications. A preferred embodiment of the invention is a line post insulator having a universal end clamp, wherein the device has an electrical insulator with a base fitting for attachment to a support structure at one end and a universal clamp attached to the other end. The clamp of the invention has a body defining a saddle for receiving a conductor when the insulator is extending either substantially horizontally or substantially vertically from the support structure, and the clamp has a captive bolt upon which a keeper is movable along a track defined in the body for securing a conductor in the saddle. The captive bolt is provided with a lock washer and nut to lock the keeper in place.

In the following description the preferred embodiment of the invention is explained, wherein the clamp of the invention is combined with an insulator to provide a unique one piece line post insulator clamp. The skilled person will appreciate that the clamp may likewise be combined with other insulator hardware for use in a variety of transmission line applications. For example, an insulator may have a clamp attached at both ends to provide a device for wind stabilization between adjacent conductors.

BRIEF DESCRIPTION OF THE DRAWINGS

As shown in FIG. 1, the preferred one piece insulator and clamp 10 of the invention for use as a line post insulator clamp comprises a base fitting 12, insulator 13 and clamp 14 in a unitary structure. The base fitting 12 and insulator 13 are of conventional design, the base fitting 12 being crimped onto the insulator 13. The clamp 14 is likewise crimped onto the other end of the insulator 13.

Referring to FIG. 3, the base fitting 12 has a threaded opening 17 for securing the device 10 to a support structure in a conventional manner. Likewise, the insulator 13 of the device 10 is of a conventional construction. Both the base fitting 12 and the clamp 14 are crimped to ends of the insulator 13 in accordance with the conventional manufacturing practice in this field.

Figure 1:
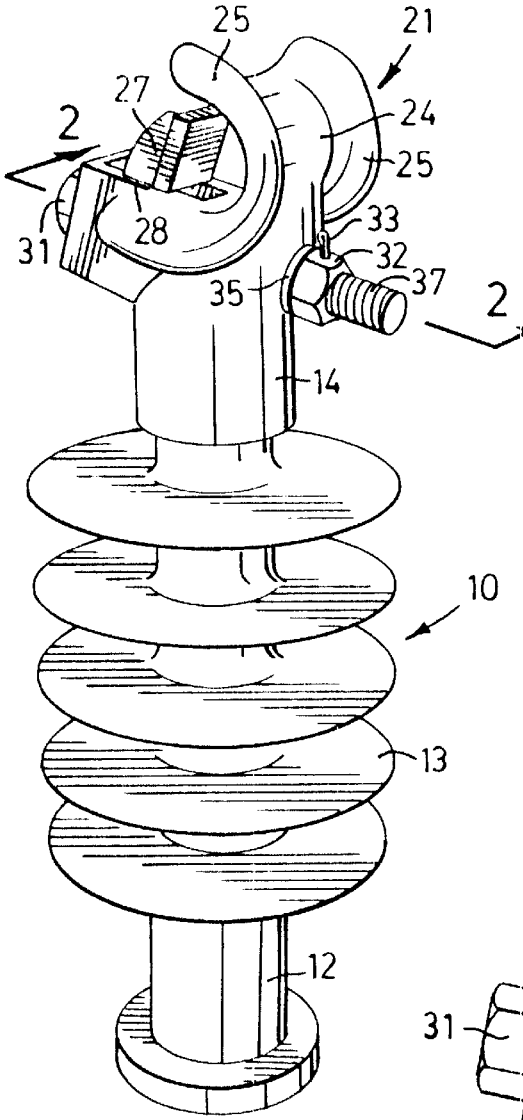
FIG. 1 is a perspective view of a preferred embodiment of the invention.
Figure 3:
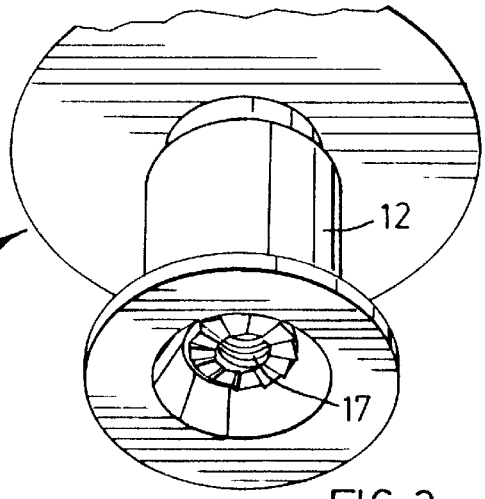
FIG. 3 is a perspective detail showing the support structure side base fitting.
Figure 2:
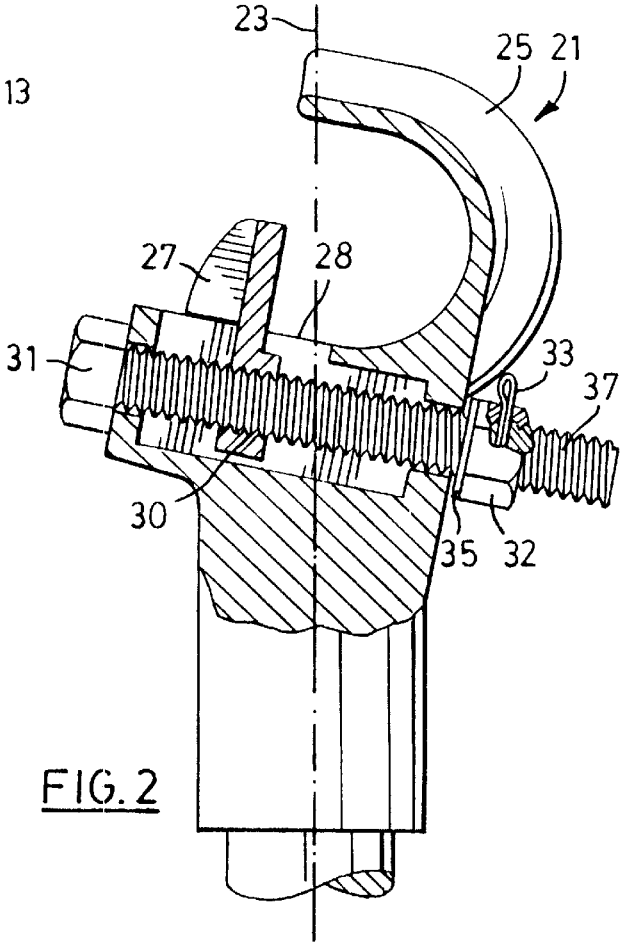
FIG. 2 is a partial cross sectional view showing details of the clamp.

The clamp 14 replaces the standard horizontal and vertical trunnion arrangement, live line clamps, and the ceramic top tie insulator which have been used extensively in the industry for many decades. The clamp 14 has a saddle 21 which is oriented transversely to the central longitudinal axis 23 (FIG. 2) of the device 10 and which is offset at a slight downwardly tilting angle from the perpendicular to the axis 23. Preferably, the saddle 21 is generously sized to accommodate the full range of conductor sizes, e.g., from 0.25 inch to 1.35 inch diameter conductors. Preferably, the saddle 21 has a relatively long, smooth conductor clamping zone 24 and outwardly flaring contoured ends 25 to provide secure clamping and to eliminate abrasion of the conductor. The orientation of the saddle 21 and its depth allow the clamp 14 to effectively secure a conductor when the device 10 is attached to a support structure in either a substantially vertical or in a substantially horizontal fashion.

The clamp 14 has a keeper 27 which is movable along a track 28 defined in the clamp body 14. The keeper 27 has a threaded bore 30 (FIG. 2) for receiving a bolt 31 which extends through unthreaded openings in the clamp body 14. The bolt 31 is held captive in the clamp body 14 and is freely rotatable therein. This arrangement is preferably effected by providing the bolt 31 with a nut 32 having a pin 33 passing through the nut 32 and bolt 31. A lock washer 35 is inserted between the nut 32 and the clamp body 14 to allow the keeper 27 to be secured onto the conductor seated in the saddle 21. The range of movement for the keeper 27 allowed by the structure of the clamp 14 is such as to enable the seating and clamping of the full range of conductor diameters.

In operation, the device 10 is secured to a support structure in either a substantially horizontal or vertical orientation usually by securing base fitting 12 onto a mounting stud. After stringing, the conductor is transferred from the stringing traveller directly to the clamp saddle 21 and is secured in place by rotating the bolt 31 to draw down the keeper 27 firmly over the seated conductor. The lock washer 35 and captive nut 32 operate to retain the keeper firmly in place. The procedure for using the clamp is simple, quick and easily performed even under adverse or live line working conditions.

The one piece insulator and clamp system 10 of the invention provides a number of advantages over prior devices and solves a number of problems associated with devices in standard use currently.

For the purpose of stringing new conductor, conventional trunnion style insulators allowed for the attachment of a conductor stringing block. Preferably, the device 10 has a bolt 31 with a projecting end portion 37 for the attachment of a standard eyenut allowing a conductor stringing traveller to be attached to the device 10. Transfer of the conductor from the stringing traveller to the clamp saddle 21 involves just one operation, namely, the lifting of the conductor over a much shorter distance than is the case with conventional systems.

Significantly, the line crew only requires an adequate supply of the one piece device 10 of the invention in order to install a conductor. The old top tie style ceramic insulators which are still in use are heavy, cumbersome and labor intensive to use. Working the tie wires required to secure the conductor in place on the top tie insulator has proven to be a safety hazard as the long tie wires can come in contact with nearby live conductors. Additionally, tie wire slippage causes premature wear and abrasion to the conductor and insulator.

The trunnion style clamp has been in common use for nearly thirty years and has largely supplanted the top tie insulator. While the trunnion clamp successfully eliminated tie wires, the use of removable bolts and the need for several sizes of clamp also makes the use of this securement device labor intensive. The clamp pivoting in a trunnion was apparently thought to allow for conductor motion. However, on most distribution lines there is little conductor motion because of the high line tension over short spans between large amplitude, low frequency support structures. Accordingly, there is negligible clamp articulation rendering the trunnion clamp over designed for the purpose. Similarly, any aeolian conductor vibration (small amplitude, high frequency) pivots about the clamping points, so an articulated joint at the clamp is not deemed necessary. Importantly, the articulated joint of the trunnion clamp makes installation and maintenance awkward and often hazardous.

Both the trunnion clamp pivot points and the tie wires of the top tie insulator can allow metal to metal gaps which under the influence of the energized line can create an electrical potential difference across such gaps resulting in discharges producing radio and television signal interference. The device of the invention has no moving parts when installed, and thus, the problem of radio and television interference is virtually eliminated.

In summary, the combination one piece insulator and clamp of the invention provides the first significant advance in the art in over 25 years. Problems associated with the prior devices are addressed and solved by the invention enabling safer installation and maintenance.

While the invention has been described with reference to the preferred embodiment, variants within the scope of the invention will be apparent to the skilled person. The scope of the invention accordingly is defined by the following claims.

I claim:

1. A one piece electrical power line insulator and universal end clamp device, comprising:

an electrical insulator having first and second ends; and a fixed position conductor clamp permanently attached to the second end of the insulator, said clamp being in a fixed position relative to the insulator and having a body defining a saddle for receiving a conductor when the insulator is extending either substantially horizontally or substantially vertically from a line post, the saddle of the clamp extending transversely of a central axis extending longitudinally of the device, the saddle being offset at a downward tilting angle from the perpendicular to the central axis so that the saddle may receive and hold a conductor when the device is oriented either substantially vertically or substantially horizontally, and having a bolt extending through and being held by the body upon which a keeper is movable along a track defined in the body away from and toward the saddle, said keeper being securable about a conductor seated in the saddle by locking means coacting with the bolt; and said bolt defines the angle of tilt for the saddle relative to the longitudinal central axis.

2. A device as claimed in claim 1, further comprising a base fitting attached to the first end of the insulator, said fitting being attachable to a support structure.

3. A device as claimed in claim 2, wherein the base fitting has a threaded opening for securement to the support structure.

4. A device as claimed in claim 1, wherein the saddle has outwardly flared ends.

5. A device as claimed in claim 1, wherein the saddle and keeper are sized to accommodate conductor diameters ranging from 0.25 inch to at least 1.35 inch.

6. A device as claimed in claim 1, wherein the locking means for the bolt is a captive nut and lock washer tightenable against the clamp body to secure the keeper in place.

7. A device as claimed in claim 6, wherein the captive nut is held stationary on the bolt by a pin extending transversely through the nut and bolt.

8. A device as claimed in claim 1, wherein the bolt extends sufficiently beyond the body so that an accessory device may be attached thereto.

9. A device as claimed in claim 8, wherein the accessory device is a conductor stringing traveller.

* * * * *